US008663135B2

(12) United States Patent
Hirata et al.

(10) Patent No.: US 8,663,135 B2
(45) Date of Patent: Mar. 4, 2014

(54) BELT BUCKLE DEVICE

(75) Inventors: Takashi Hirata, Wako (JP); Hideo Shimizu, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 448 days.

(21) Appl. No.: 12/987,432

(22) Filed: Jan. 10, 2011

(65) Prior Publication Data

US 2011/0168485 A1 Jul. 14, 2011

(30) Foreign Application Priority Data

Jan. 11, 2010 (JP) ..... 2010-003504

(51) Int. Cl.
*A61H 3/00* (2006.01)

(52) U.S. Cl.
USPC ..... 601/35; 182/3; 24/303

(58) Field of Classification Search
USPC ..... 601/5, 23, 33, 34, 35; 182/3; 24/303, 24/593.1; 602/19, 23, 26
See application file for complete search history.

(56) References Cited

U.S. PATENT DOCUMENTS

| | | | | |
|---|---|---|---|---|
| 3,366,996 | A * | 2/1968 | Springer | 24/303 |
| 3,424,134 | A * | 1/1969 | Rosenblum | 182/3 |
| 5,323,516 | A * | 6/1994 | Hartmann | 24/303 |
| 2008/0156583 | A1 * | 7/2008 | Meeks | 182/9 |
| 2010/0036302 | A1 * | 2/2010 | Shimada et al. | 602/16 |

FOREIGN PATENT DOCUMENTS

| | | |
|---|---|---|
| JP | 6-239201 | 8/1994 |
| JP | 11-244006 | 9/1999 |
| JP | 03-69412 U | 10/2003 |
| JP | 2009-95645 | 5/2009 |

* cited by examiner

*Primary Examiner* — Quang D Thanh
(74) *Attorney, Agent, or Firm* — Rankin, Hill & Clark LLP

(57) ABSTRACT

In a belt buckle device including a tongue piece (75, 76; 210; 310) connected to an end of a belt extending in a longitudinal direction and a hook member (68, 70; 220; 320) configured to be selectively connected to the tongue piece by engaging a first lateral bar of the tongue piece in a hook opening (111; 226; 326) defined by a hook portion (71, 72; 225; 324) thereof, a longitudinal dimension (B) between the free end of the tongue piece and a base end side of the first lateral bar is substantially equal to or smaller than a width (A) of the entrance of the hook opening, and the effective thickness (C) of the first lateral bar is greater than the width (A) of the entrance of the hook opening. Thus, the first lateral bar is held inside the hook opening as long as the tongue piece is kept in a flat position in a reliable manner. In particular, the first lateral bar can be freely introduced into the hook opening simply by raising the base end of the tongue piece while the first lateral bar is applied to the entrance of the hook opening so that the belt buckle device can be readily fastened even when the belt buckle device cannot be viewed from a proper viewing angle. Also, the belt buckle device can be readily fastened with a minimum dexterity requirement and very quickly.

9 Claims, 6 Drawing Sheets

210
216
212
214
211
213
214
225
227
220
223
226

213
211
210
214
227
225
212
220
223
216
226

213
211
210
212
225
214
226
227
220
223
216

225
214
211
213
216
210
227
223
212
220
214
longitudinal direction

BELT BUCKLE DEVICE

TECHNICAL FIELD

The present invention relates to a belt buckle device for joining two lengths of belt to each other or a belt with another member, and in particular to a belt buckle device suitable for use in a pelvic frame of a walking assistance device.

BACKGROUND OF THE INVENTION

An automotive seat belt device comprises a belt buckle for fastening a belt, and the belt buckle is typically configured to detachably retain thereto a tongue piece connected to an end of the belt. See Japanese patent laid open publication No. 6-239201 (patent document 1). According to the known seat belt device, when fastening the belt, the user is required to hold the tongue piece and buckle by two hands, respectively, and insert the tongue piece into an opening of the buckle. If the buckle is clearly visible to the user and fixed in position, the seat belt may be fastening by using one hand, but there may be some difficulty in properly positioning the tongue piece with respect to the opening of the buckle particularly when the user is unable to see the buckle from a proper viewing angle.

Such belt buckle devices are also used for other applications such as securing various members on the body of a user. Such members, not exclusively, include footwear, protective gears and frame members for assisting a handicapped person.

BRIEF SUMMARY OF THE INVENTION

In view of such problems of the prior art, a primary object of the present invention is to provide a belt buckle device that can be readily fastened even when the belt buckle device cannot be viewed from a proper viewing angle.

A second object of the present invention is to provide a belt buckle device that can be readily fastened with a minimum dexterity requirement.

A third object of the present invention is to provide a belt buckle device that can be readily fastened very quickly.

According to the present invention, such objects can be accomplished by providing a belt buckle device including a tongue piece connected to an end of a belt extending in a longitudinal direction and defining a major surface and a hook member configured to be selectively connected to the tongue piece, wherein the tongue piece comprises a base end connected to an end of a belt and a free end provided with at least a first lateral bar; wherein the hook member comprises a main body and a hook portion extending from a free end of the main body toward a base end thereof so as to define a hook opening directed toward the base end thereof and configured to receive the lateral bar therein; and wherein a longitudinal dimension between the free end of the tongue piece and a base end side of the first lateral bar is substantially equal to or smaller than a width of the entrance of the hook opening, and the effective thickness of the first lateral bar is greater than the width of the entrance of the hook opening.

Thus, the first lateral bar is held inside the hook opening as long as the tongue piece is kept in the flat position, and this ensures a reliable coupling between the two parts of the belt buckle device. In particular, the first lateral bar can be freely introduced into the hook opening simply by raising the base end of the tongue piece while the first lateral bar is applied to the entrance of the hook opening so that the belt buckle device can be readily fastened even when the belt buckle device cannot be viewed from a proper viewing angle. Also, the belt buckle device can be readily fastened with a minimum dexterity requirement and very quickly.

According to a preferred embodiment of the present invention, the effective thickness of the first lateral bar is defined by a combined thickness of the first lateral bar and a longitudinal bar connecting the first lateral bar with the base end of the tongue piece, and the tongue piece comprises a pair of spaced apart longitudinal bars that join two ends of the first lateral bar to the base end of the tongue piece. Also, the hook opening may be wider in an interior thereof than in an entrance thereof for improving the stability of the fastened state of the belt buckle device. In this connection, a surface of the hook portion facing the hook opening may be provided with a recess that defines the wider interior of the hook opening.

If the tongue piece is provided with a second lateral bar located between the first lateral bar and base end of the tongue piece, and the second lateral bar is configured to engage a surface of the hook portion facing away from the hook opening when the first lateral bar is engaged in the hook opening, the belt buckle device can be kept fastened in a stable manner even under a significant tension.

To aid the positioning of the first lateral bar suitable for insertion into the hook opening, and the fastening of the belt buckle device by using a single hand, a free end of the tongue piece is provided with a first magnetic member, and a part of the hook member main body adjacent to the entrance to the hook opening is provided with a second magnetic member which is magnetically attracted to the first magnetic member. For the same purpose, additionally or alternatively, the free end of the tongue piece may be provided with an end surface substantially perpendicular to the longitudinal direction, and an adjoining inner surface substantially in parallel with the major plane of the belt.

If the a width of an interior part of the hook opening is slightly smaller than the effective thickness of the first lateral bar, the first lateral bar may be held in the hook opening in a stable manner under the resilient clamping force of the hook portion.

This belt buckle device is particularly suitable for attaching a assisting device for a handicapped person to the body of the user. According to a certain aspect of the present invention, the present invention provides a femoral support assembly for transmitting a walking assistance force to a femoral part of a user, comprising a swing arm having a base end connected to an output end of a power generator and a free end opposing a front part of the femoral part of the user, a femoral support member pivotally connected to the free end of the swing arm and having a support surface engaging the front part of the femoral part of the user, and a femoral belt passed around the femoral part of the user and having two ends attached to corresponding lateral ends of the femoral support member, one of the two ends of the femoral belt being connected to the corresponding lateral end of the femoral support member via a belt buckle device that includes a tongue piece connected to an end of a belt extending in a longitudinal direction and defining a major surface and a hook member configured to be selectively connected to the tongue piece, wherein the tongue piece comprises a base end connected to an end of a belt and a free end provided with at least a first lateral bar; wherein the hook member comprises a main body and a hook portion extending from a free end of the main body toward a base end thereof so as to define a hook opening directed toward the base end thereof and configured to receive the lateral bar therein, the hook opening being wider in an interior thereof than in an entrance thereof; and wherein a longitudinal dimension between the free end and a base end side of the first lateral bar is smaller than a width of the entrance of the hook opening, and the effective thickness of the first lateral bar is greater than the width of the entrance of the hook opening.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
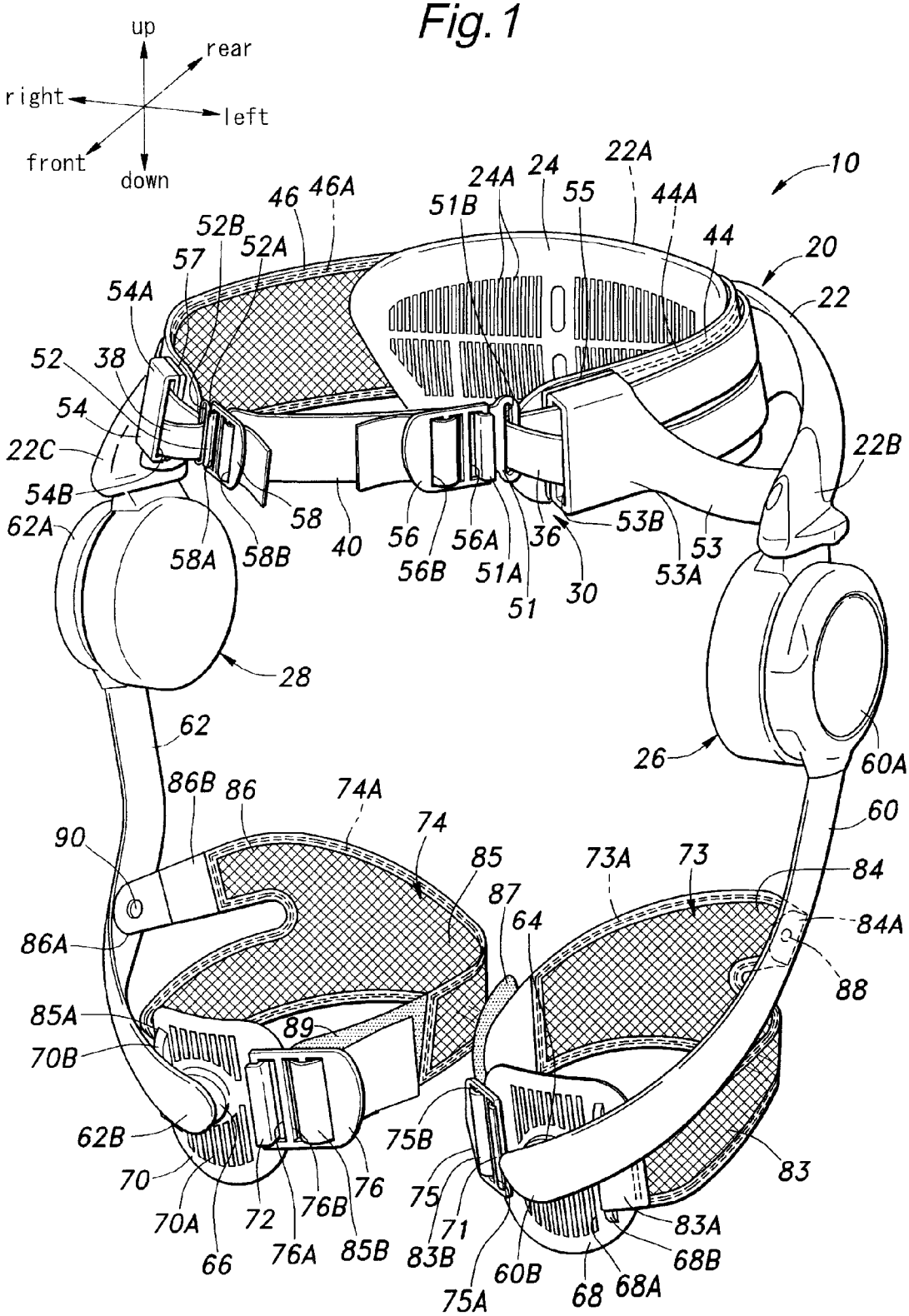
FIG. 1 is a perspective view of a walking assistance device incorporated with belt buckles devices embodying the present invention.

An embodiment of the walking assistance device of the present invention will now be described in the following with reference to FIG. 1. In the following description, the direction of the walking assistance device will be based on the directional arrows shown in each of the drawings. When the device is worn by the user, the front and back directions of the walking assistance device coincide with the coronal axis, while the left and right directions coincide with the sagittal axis.

The walking assistance device 10 is provided with a pelvic support assembly 20. The pelvic is support assembly 20 is configured to be worn on the pelvic part of the user, and includes a main frame 22 that extends outwardly from a lower back part of the user to either side of the pelvic part to form a C-shape when viewed in plan view. The main frame 22 is formed with molded plastic material such as polyimide resin, glass fiber reinforced plastic material, carbon fiber reinforced plastic material or other material having a high stiffness and mechanical strength.

A middle part 22A of the main frame 22 is formed with a storage opening (FIG. 2) passed across the thickness thereof for receiving an electronic unit including a control unit and a battery. A back support member 24 is attached to the inner side of the middle part 22A of the main frame 22. The back support member 24 is made of a plastic plate member having a high resiliency, and is formed with a number of vertical slots 24A arranged laterally at a regular interval for promoting air permeability and enhancing resiliency with the aim of improving the comfort of the user.

A left end part 22B and a right end part 22C on either side of the main frame 22 are positioned outwardly on either side of the user, and are each provided with a power generator mainly consisting of a motor unit 26, 28. The upper end of each motor unit 26, 28 is connected to the corresponding end part 22B, 22C of the main frame 22 via a hinge having a hinge axis extending in the coronal axis (front/back directional axis) of the user so that the motor unit 26, 28 is suspended from the upper end part, and can rotate around the hinge axis within a prescribed angular range.

Along the inner side of the main frame 22 extends an abdominal belt 30, which is wrapped around the abdominal part of the user. The abdominal belt 30 of this embodiment includes a left side belt 36, a right side belt 38 and a front belt 40. These parts 36, 38 and 40 are each made of flexible materials such as fabric and leather.

The left side belt 36 is passed through an opening 51B of a left engagement piece 51, and the two ends of the left side belt 36 are attached to an upper and lower part of the inner side of the middle part 22A of the main frame 22, respectively, so as to form a loop. Therefore, the left side belt 36 is reversed over in the shape of letter V at the left engagement piece 51. The length of the left side belt 36 can be adjusted by using a belt length adjustment buckle (not shown in the drawings) provided in a middle part of the belt. The left hook engagement piece 51 is made of plastic or metallic material, and is further provided with a left hook shaped part 51A.

Similarly, the right side belt 38 is passed through an opening 52B of a right engagement piece 52, and the two ends of the right side belt 38 are attached to an upper and lower part of the inner side of the middle part 22A of the main frame 22, respectively, so as to form a loop. Therefore, the right side belt 38 is reversed over in the shape of letter V at the right engagement piece 52. The length of the right side belt 38 can be adjusted by using a belt length adjustment buckle (not shown the drawings) provided in a middle part of the belt. The right engagement piece 52 is made of plastic or metallic material, and is further provided with a right hook shaped part 52A.

In the illustrated embodiment, each of the left and right engagement pieces 51 and 52 is made of a flat plate member having a slightly greater width than the belts 36 and 38.

Each end of the front belt 40 is fitted with a buckle 56, 58 provided with an opening 56A, 58A configured to receive the hook shaped part 51A, 52A of the corresponding engagement piece 51, 52. Each of the buckles 56, 58 is provided with a pair of rectangular openings 56B and 58B separated by a lateral bar for passing the corresponding end of the front belt 40 in a length adjustable manner. The left and right buckles 56 and 58 are each made of a flat plate member having a slightly greater width than the front belt 40.

Therefore, the front belt 40 can be detachably connected to the left and right side belts 36 and 38 by engaging the hook shaped parts 51A and 52A of the engagement pieces 51 and 52 with the openings 56A and 58A of the corresponding buckles 56 and 58. When the three parts of the abdominal belt 30 are connected to one another as described above, the abdominal belt 30 forms a loop that surrounds the abdominal part of the user. By suitably adjusting the length of each part of the abdominal belt 30 and snugly wrapping the abdominal belt 30 around the abdominal part of the user, the main frame 22 can be securely fitted to the pelvic part of the user without causing discomfort to the user.

The pelvic support assembly 20 further comprises a left supporter piece 44 and a right supporter piece 46. Each supporter piece 44, 46 is made of relatively stiff sheet member having a vertical width greater than the combined width of the two runs of the corresponding abdominal belt 36, 38 extending along the outer surface of the supporter piece 44, 46. Each supporter piece 44, 46 has a base end located between the back support member 24 and corresponding side belt 36, 38, and is jointly secured to the main frame 22, and extends along the inner surface of the side belt 36, 38. To impart a suitable stiffness to each supporter piece 44, 46, a resilient plastic or metallic wire 44A, 46A may be incorporated in the supporter piece 44, 46, for instance, along the outer periphery thereof.

Thus, the supporter pieces 44 and 46 are flexible enough to conform to the contour of the pelvic part of the user but stiff enough to distribute the pressure from the left and right side belts 36 and 38 over a large area of the body of the user so that the comfort of the user may be enhanced. Also, in order to increase the air breathability, and ensure the comfort to the user in a warm weather, the supporter pieces 44 and 46 may be at least partly made of a mesh type fabric or other air permeable material.

The base end of the left supporter piece 44 is secured to the middle part 22A of the main frame 22, and extends between the back support member 24 and left abdominal belt 36 as mentioned earlier. The free end of the left supporter piece 44 terminates at a point adjacent to the left engagement piece 52 in the illustrated embodiment, but may also extend slightly beyond the left engagement piece 52.

Similarly, the base end of the right supporter piece 46 is secured to the middle part 22A of the main frame 22, and extends between the back support member 24 and right abdominal belt 38. The free end of the right supporter piece 46 terminates at a point adjacent to the right engagement piece 54 in the illustrated embodiment, but may also extend slightly beyond the left engagement piece 52. The right supporter piece 46 extends along the side of the user in a similar fashion as the left supporter piece 44.

A stabilizer member 53, 54 is connected to each end part 22B, 22C of the main frame 22. Each stabilizer member is made of an elongated, relatively stiff plastic member having a base end pivotally attached to the inner side of the corresponding end part 22B, 22C via a pivot member so as to be rotatable around a pivot axis substantially in parallel with the sagittal axis or so as to be rotatable in the vertical direction.

Each stabilizer member 53, 54 has a free end 53A, 54A formed with a passage 53B, 54B through which the two runs of the corresponding side belt 36, 38 are passed. The passage 53B, 54B has a certain length so that the stabilizer member 53, 54 may evenly engage a corresponding length of each run of the belt. The free end 53A, 54A of each stabilizer member 53, 54 is attached to a free end part of the corresponding supporter piece 44, 46 via a cushioning member 55, 57 such as a foamed plastic piece.

The stabilizer members 53 and 54 are made of a relatively stiff molded elastomeric material such as vulcanized rubber. The main part of each stabilizer member 53, 54 consists of a strip member having a relatively large width as compared to the thickness thereof and having a major plane extending along the outer contour of the abdominal part of the user. Therefore, the stabilizer members 53 and 54 are compliant in the direction to conform to the outer contour of the abdominal part of the user, but is relatively stiff against the bending deformation in the vertical direction.

As the abdominal belt 30 is fastened around the abdominal part of the user, and is tightened, the stabilizer members 53 and 54 deflect inwardly against the body of the user, and the free ends 53A and 54A thereof are placed adjacent to or slightly above the anterior superior iliac spine of the user.

Each electric motor unit 26, 28 is positioned so as to coincide with the corresponding hip joint of the user, and is provided with an angular sensor (not shown in the drawings). To the output end of each electric motor unit 26, 28 on the exterior side thereof is releasably attached a base end part 60A, 62A of a swing arm 60, 62 in a torque transmitting relationship.

Each swing arm 60, 62 is made of highly stiff and strong material such as aluminum, glass fiber reinforced plastic material, and carbon fiber reinforced plastic material. The main part of each swing arm 60, 62 consists of a hollow member having an elliptic cross section as illustrated in FIG. 2. The cross section of each swing arm 60, 62 is highly elongated along a major plane extending perpendicularly to the sagittal axial at the base end 60A, 62A thereof. Each swing arm 60, 62 is generally twisted so that the major plane of the free end 60B, 62B, which is located adjacent to a lower end of the femoral part, extends perpendicularly to the coronal axis.

The free end 60B, 62B of each swing arm 60, 62 is fitted with a front femoral support member 68, 70 via a coupling 64, 66 that permits angular movement of the femoral support member 68, 70 relative to the free end 60B, 62B of the swing arm 60, 62. Each front femoral support member 68, 70 is formed of a substantially rectangular plate member made of plastic material, and is curved in the shape of a part-cylindrical surface so as to conform to the outer contour of the lower femoral part of the user. Each front femoral support member 68, 70 is formed with a number of vertical slots 68A, 70A arranged laterally at a regular interval for promoting air permeability and enhancing resiliency with the aim of improving the comfort of the user.

Each femoral support member 68, 70 is fitted with a femoral belt 73, 74 for retaining the femoral support member 68, 70 to the femoral part of the user as shown in FIG. 1. Each femoral belt 73, 74 includes a main belt portion 83, 85 that surrounds the femoral part of the user in cooperation with the corresponding femoral support member 68, 70, and an auxiliary belt portion 84, 86 integrally bifurcated from an intermediate part of the main belt portion 83, 85. The two femoral belts 73 and 74 are mirror images of each other. The femoral support assembly is now described in the following. As the two femoral support assemblies are mirror images of each other, only the right femoral support assembly is described in the following. A first end 83A of the main belt portion 83 is secured to a belt engaging bar 68B extending vertically on one lateral side of the femoral support member 68, and a second end 83B of the main belt portion 83 is fitted with a tongue piece 75. The tongue piece 75 includes four lateral bars and a pair of longitudinal bars connecting the corresponding ends of the lateral bars. The femoral belt 73 is passed through an opening 75B defined between the second and third lateral bars from inside to outside, and is then passed through the opening defined between the first and second lateral bars from outside to inside, the lateral bars being counted from the end adjacent to the femoral belt 73. Thus, the free end of the femoral belt 73 is passed between the first lateral bar and the remaining part of the femoral belt, from outside to inside. Thus, the femoral belt 73 is frictionally engaged against loosening when fastened while enabling the femoral belt 73 to be tightened by pulling the free end of the femoral belt 73. In the illustrated embodiment, a surface fastener 87 is attached to the outer side of the free end of the femoral belt 73 so that the parts of the femoral belt overlying each other near the base end of the tongue piece 75 can be joined to each other, and the femoral belt 73 is positively prevented from slackening during use.

If desired, the surface fastener may also be applied to the abdominal belt 30 or in particular the front belt 40 for the purpose of preventing the loosening or slackening of the abdominal belt 30.

The femoral support member 68 is formed with a hook portion 71 on the opposite lateral side thereof. The hook portion 71 is formed on the front side of the femoral support member 68 so as to define a hook opening facing away from the adjacent lateral edge of the femoral support member 68. Thereby, the tongue piece 75 can be secured to the femoral support member 68 by engaging the hook portion 71 in the opening defined between the first and second lateral bars of the tongue piece.

The free end of each auxiliary belt part 84 is fitted with a grommet 84C, and is connected to an intermediate part of the corresponding swing arm 62 via a pivot pin 88 fixedly secured to the swing arm 60 and rotatably received in the grommet 84C.

Thus, the main belt portion 83 is wrapped around the femoral part of the user by securing the base end of the main belt portion 83 to the belt engaging bar 68B of the femoral support member 68 and engaging the tongue piece 75 with the hook portion 71 provided on the opposite lateral end of the femoral support member 68.

The main belt portions 83 and 85 as well as the auxiliary belt portions 84 and 86 may be made of any flexible material such as fabric and leather, and may be at least partly made of mesh material as denoted in numerals 73B and 74B. Resilient plastic wires 73A, 73B are incorporated along the lateral edges of the mesh material 73B, 74B so that the femoral belt 73, 74 may maintain a curved shape so that the handling of the femoral belt 73, 74 may be improved during the fastening and releasing of the femoral belt.

In the illustrated embodiment, the auxiliary belt portions 84 and 86 are at least partly incorporated with elastic rubber belts 84B and 86B so that the variation in the build of the user may be accommodated by the extension and contraction of the auxiliary belt portions 84 and 86, and the comfort of the user may be improved.

Each femoral belt 73, 74 including the main belt portion 83, 85 and auxiliary belt potion 84, 86 assumes an inverted frustoconical shape when the free end of the main belt portion 83, 85 is connected to the femoral support member 68, 70 via the belt buckle including the tongue piece 75, 76 and the hook portion 71, 72 so as to conform to the outer contour of the lower femoral part of the user. Thus, each femoral belt 73, 74 may be shaped three-dimensionally by using the draping technique so as to optimally conform to the femoral part of the user.

Thus, the free end of each swing arm 60, 62 can engage the lower part of the corresponding femoral part of the user by passing the femoral belt 73, 74 around the femoral part of the user, and engaging the hook-shaped part 71, 72 with the opening 75A, 76A of the corresponding tongue piece 75, 76. By appropriately tightening the femoral belt 73, 74 by using the tension adjusting feature of the tongue piece 75, 76, the femoral part of the user can be securely but releasably engaged by the free end of the swing arm 60, 62.

By actuating the motor units 26 and 28 in dependence on the walking effort made by the user (which can be detected by using suitable load sensors not shown in the drawings), the user is assisted in the effort to walk not only by the assisting power provided by the motor units 26 and 28 but also by the gait or pace also provided by the motor units 26 and 28 for the purpose of helping the user regain the motor coordination required for walking. The motor units 26 and 28 are provided with angular sensors so that the angular movements of the motor units 26 and 28 may be accurately controlled by feedback control.

Figure 2A:
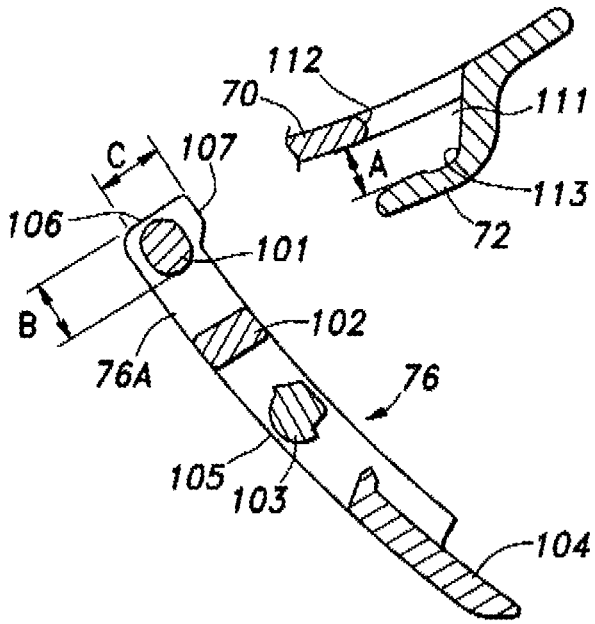
FIGS. 2*a* to 2*c* are sectional views showing the process of fastening the belt buckle device of the first embodiment.
Figure 2B:
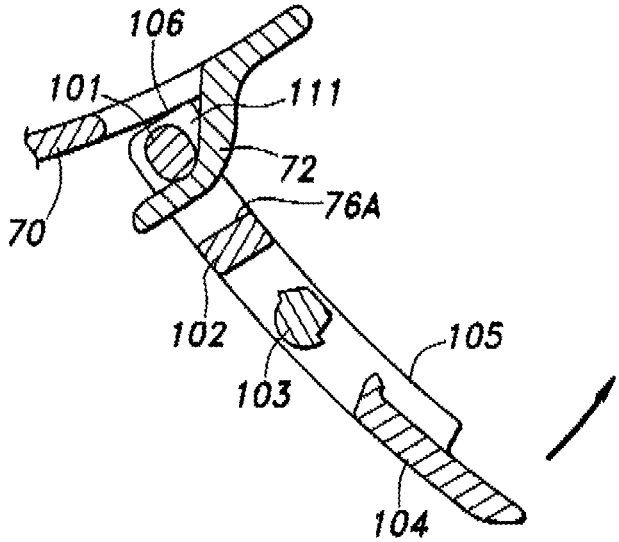
Figure 2C:
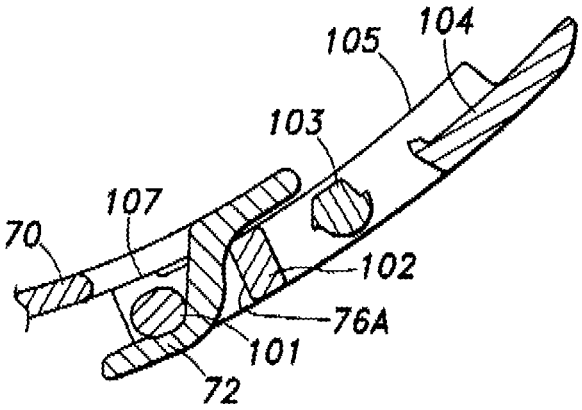

FIGS. 2*a* to 2*c* show the mode of engagement between the tongue piece 76 connected to the free end of the femoral belt 74 and hook portion 72 of the femoral support member 70.

The tongue piece 76 comprises four lateral bars 101 to 104 and a pair of longitudinal bars 105 connecting the corresponding ends of the lateral bars 101 to 104 in the manner of a ladder. More specifically, the longitudinal bars 105 are spaced from each other in a mutually parallel relationship, and the four lateral bars 101 to 104 are also parallel to each other, and perpendicular to the longitudinal bars 105.

Figure 3:
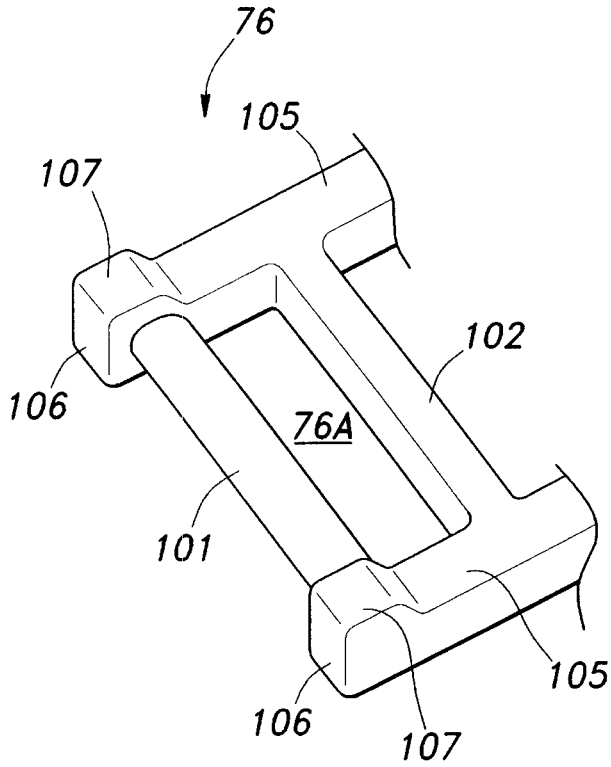
FIG. 3 is a fragmentary perspective view showing a free end portion of the tongue piece of the first embodiment.

As best shown in FIG. 3, the free end of each longitudinal bar 105 is given with a locally increased thickness, and defines an end surface 106 substantially perpendicular to the longitudinal direction, and an adjoining inner surface 107 substantially in parallel with the major plane of the belt. The first lateral bar 101 (as counted from the free end) has an effective longitudinal width B as measured between the end surface 106 and the side of the first lateral bar 101 facing away from the end surface 106, and an effective thickness C as measured between the inner surface 107 of the longitudinal bars 105 and an outer surface of the first bar 101 facing away from the inner surface 107. In the illustrated embodiment, the effective longitudinal width B and effective thickness C are partly defined by the longitudinal bars 105, but may also be defined solely by the first lateral bar 101 by suitably dimensioning the first lateral bar 101 with respect to the longitudinal bars 105.

As can be seen in FIG. 1, the femoral belt 74 is passed along the inner sides of the third and fourth bars 103 and 104, and after being passed through the opening between the second and third bars 102 and 103, from inside to outside, wound around the third bar 103. The femoral belt 74 is then passed into the opening between the third and fourth bars 103 and 104, from outside to inside, and between the fourth bar 104 and the adjacent part of the femoral belt 74. As the third bar 103 is provided with relatively sharp edges thereon so that the femoral belt 74 is frictionally engaged by the third and fourth bars 103 and 104. As the edges are directed in the direction to oppose the unwinding of the belt from the third bar 103, the belt can be tightened by pulling the free end of the belt without encountering a significant frictional force, but is resisted from being unwound from the third bar 103.

The hook portion 72 of the femoral support member 70 extends from the corresponding lateral end (free end) of the femoral support member 70 toward the central part (base end) of the femoral support member 70 defining a hook opening 111 directed toward the central part of the femoral support member 70 in cooperation with the main body of the femoral support member 70. The part of the main body of the femoral support member 70 facing the hook portion 72 is provided with an opening 112 for the convenience of injection molding the femoral support member 70 integrally formed with the hook portion 72. The width (thickness-wise width) of the entrance of the hook opening 111 is A, and the width of the interior of the hook opening 111 is slightly greater than this width A on account of a recess 113 formed in the inner side of the hook portion 72 facing the main body of the femoral support member 70. The hook portion 72 has a lateral width substantially corresponding to the width of the belt.

The opening 76A defined between the first and second bars 101 and 102 of the tongue piece 76 is configured to receive the hook portion 72 therein. The effective longitudinal width B of the first lateral bar 101 is equal to or smaller than the width A of the entrance of the hook opening 111, and the effective thickness C of the first lateral bar 101 is greater than the width A of the entrance of the hook opening 111. If the hook portion 72 is highly flexible and resilient, the effective longitudinal width B may be slightly greater than the width A of the entrance of the hook opening 111 as the width A can be slightly increased by the pressure of the first lateral bar 101 that is forced into the hook opening 111.

When engaging the hook portion 72 with the tongue piece 76, the first bar 101 is forced into the hook opening 111 defined by the hook portion 72 while tilting the tongue piece 76 or raising the base end of the tongue piece 76 away from the user, as illustrated in FIG. 2*a*. Because the opening width A of the entrance of the hook opening 111 is substantially equal to or slightly greater than the lengthwise effective dimension B of the first bar 101, the first bar 101 can be introduced into the hook opening 111 without encountering any significant resistance.

When the first bar 101 is fully forced or otherwise introduced into the hook opening 111, the further movement of the first bar 101 is prevented by being engaged by the base end of the hook portion 72, and the first bar 101 is snugly received in the recess 113 of the hook portion 72. The tongue piece 76 is then brought into a flat position or brought parallel to the main body of the femoral support member 70 by bringing the base end of the tongue piece toward the body of the user as indicated by an arrow in FIG. 2*b*.

As the effective thickness C is greater than the effective longitudinal width B, and is also greater than the thicknesswise width A of the entrance of the hook opening 111, the first lateral bar 101 bears upon the hook portion 72, and is snugly received in the recess 113 of the hook portion 72. At the same time, the hook portion 72 is resiliently deflected in the direction to increase the width of the hook opening 111 so that the first lateral bar 101 is resiliently retained in the hook opening 111 as illustrated in FIG. 2*c*. In particular, owing to the provision of the recess 111 in the hook portion 72, the first lateral bar 101 is positively prevented from being dislodged from the hook opening 111, and this enables the tongue piece 104 to be kept engaged by the hook portion 72 in a stable manner. Furthermore, when the tongue piece 76 is aligned with the main body of the femoral support member 70 or placed in this flat position illustrated in FIG. 2*c*, the second lateral bar 102 abuts the outer surface of the base end of the hook portion 72. This resists the longitudinal movement of the tongue piece 76 with respect to the femoral support member 70.

As long as the tongue piece 76 is aligned with the main body of the femoral support member 70 or remains in this flat position illustrated in FIG. 2*c*, as there is a relatively sharp corner between the end surface 106 and adjacent inner surface 107 of the tongue piece 76 (or the lateral bars 105 thereof), the tongue piece 76 is prevented from being raised from the base end thereof. As a matter of fact, the tension of the femoral belt 74 tends to maintain the surface contact between the inner surface 107 and the opposing surface of the femoral support member 70, and this also contributes to the secure engagement between the tongue piece 76 and the hook portion 72.

At this time, by pulling the free end of the femoral belt 74, the tension of the belt can be increased as desired. The belt can be unfastened by raising the base end of the tongue piece 76 away from the body of the user, and dislodging the first bar 101 from the hook opening 111 of the hook portion 72. This can be relatively easily accomplished because the effective longitudinal width B of the first lateral bar 101 is equal to or smaller than the width A of the entrance of the hook opening 111. If necessary, the tension of the belt may be reduced before unfastening the belt buckle device.

The belt buckle device for the right femoral support assembly is identical to that of the left femoral support assembly so that the description of the belt buckle device for the right femoral support assembly is omitted from this application.

FIGS. 4*a* to 4*d* show a second embodiment of the present invention. The illustrated belt buckle device includes a hook member 220 including a hook portion 225 extending from a base portion 223, and a tongue piece 210 secured to an end of a belt 213. The various features included in the first embodiment may also be present in the second embodiment although the drawings may not show them in any detail, and the description of such features is omitted from the following description. The following description of the second embodiment is directed only to those features which were absent in the first embodiment or which are different from the counterparts of the first embodiment.

The hook portion 225 is given with a U shaped cross section so as to define an hook opening 226 facing toward the base portion 223. A permanent magnet 227 is attached to the base portion 223 at a suitable distance from the hook opening 226.

The tongue piece 210 includes a base portion 211 secured to a free end of the belt 213, a pair of longitudinal bars 214 extending from either side of the base portion 211 away from the belt 213 and a lateral bar 216 extending between the free ends of the longitudinal bars 214. A substantially rectangular opening 212 is thus defined by the base portion 211, longitudinal bars 214 and lateral bar 216. At least the lateral bar 216 of the tongue piece 210 is made of magnetic material that can be attracted by the permanent magnet. If desired, the whole tongue piece 210 or only a part of the tongue piece may be made of such magnetic material.

The mode of engaging this belt buckle device is described in the following with reference to FIGS. 4*a* to 4*d*. First of all, the lateral bar 216 of the tongue piece 210 is brought close to the permanent magnet 227 of the hook member 220 as illustrated in FIG. 4*a* so that the magnetic force of the permanent magnet 227 engages the lateral bar 216 thereto, preferably in an upright posture as illustrated in FIG. 4*b*.

Figures 4A, 4B, 4C, 4D:
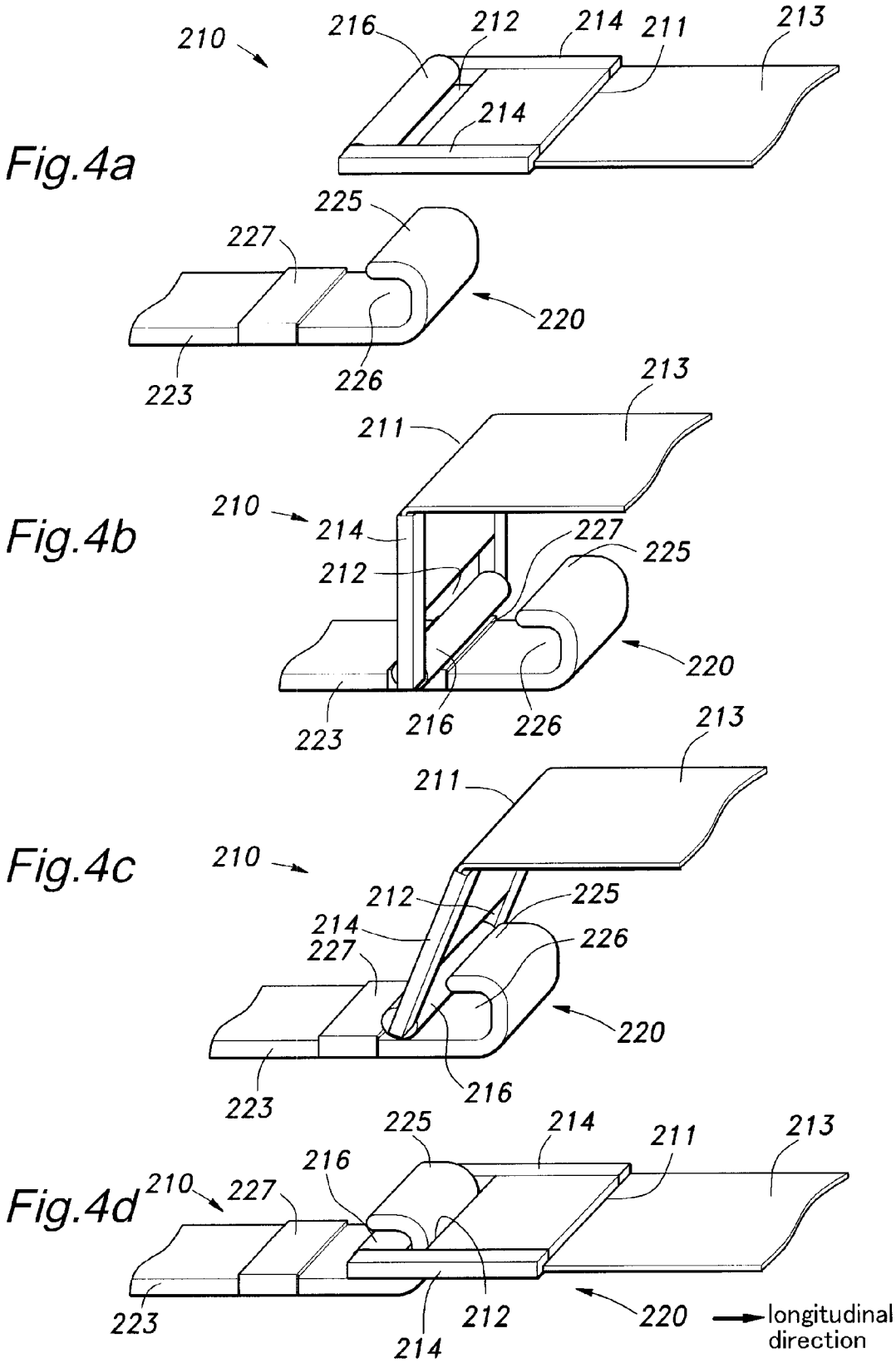
FIGS. 4*a* to 4*d* are fragmentary perspective views showing the mode of fastening the belt buckle device of a second embodiment.

Thereafter, the belt or the base portion 214 is pulled longitudinally away from the hook member 223 as illustrated in FIG. 4*c*, and this causes a pivoting movement of the tongue piece 210 around the lateral bar 216 which is engaged by the permanent magnet 224. As the tongue piece 210 is pulled further away from the hook member 223, and attains a flat or parallel position, the lateral bar 216 is engaged by the hook portion 220 without fail as illustrated in FIG. 4*d*.

Although not shown in the drawings, the tongue piece 210 may be provided with a feature for tightening the belt such as the one illustrated in FIGS. 2*a* to 2*c*. To ensure a reliable engagement between the permanent magnet 227 and lateral bar 216, the lateral bar 216 may be provided with a flat surface, preferably perpendicular to the longitudinal direction so that the permanent magnet 227 may be enabled to retain the tongue piece 210 in an upright posture as illustrated in FIG. 4*b* without fail.

This belt buckle device can be released by raising the base end of the tongue piece 210, and disengaging the lateral bar 216 from the hook opening 226. In this embodiment, the permanent magnet was provided on the side of the hook portion, and a magnetic material member such as an iron piece was provided of the tongue piece, but as can be readily appreciated by a person skilled in the art, a permanent magnet may be provided on the tongue piece 210 while the hook member 220 is provided with an iron piece or the like that can be attracted to the permanent magnet without departing from the spirit of the present invention.

Figure 5:
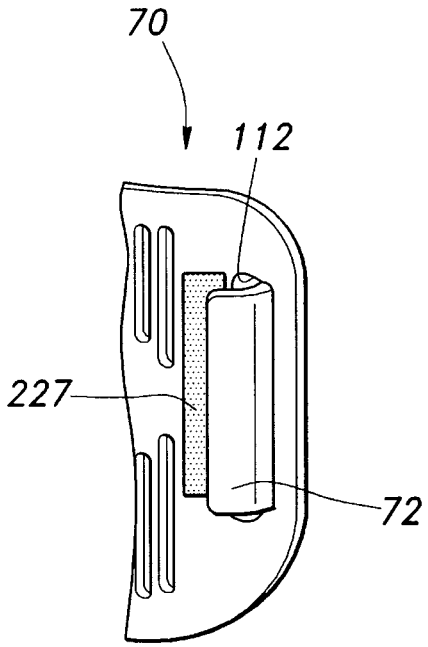
FIG. 5 is a fragmentary perspective view showing the second embodiment applied to the femoral support assembly shown in FIG. 1.

FIG. 5 shows the second embodiment applied to the femoral support member 70 illustrated in FIG. 1. The permanent magnet 227 is attached to the part of the femoral support member 70 adjacent to the entrance of the hook opening defined by the hook portion 72 in cooperation with the main body of the femoral support member 70.

Figure 6A:
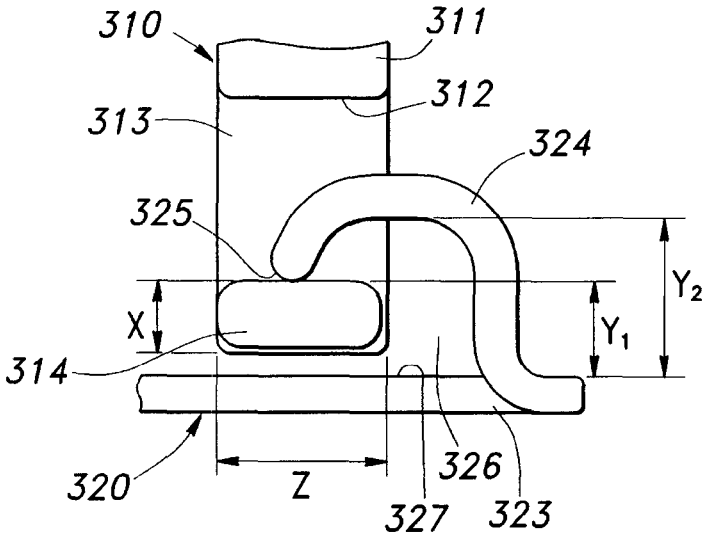
FIGS. 6*a* and 6*b* are fragmentary cross sectional side views showing the mode of fastening the belt buckle device of a third embodiment.
Figure 6B:
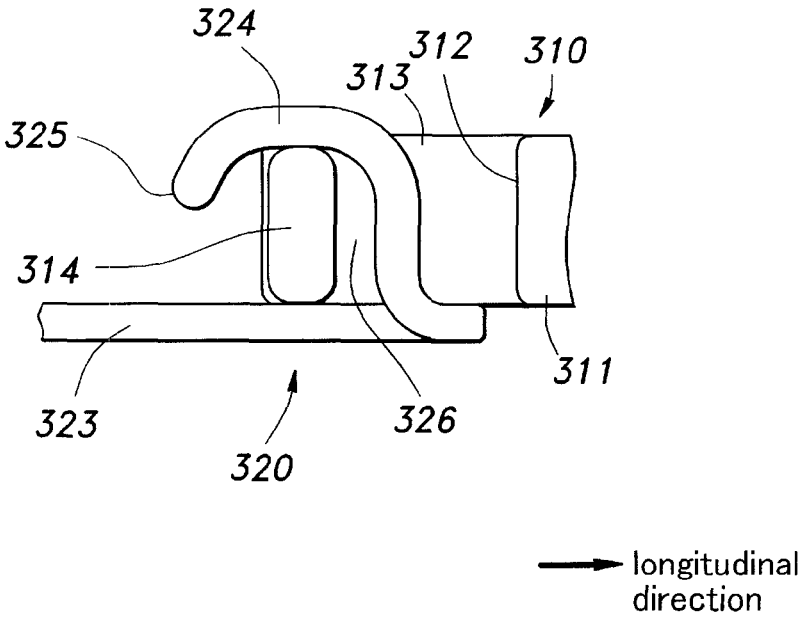

FIGS. 6*a* and 6*b* show a third embodiment of the present invention. The illustrated belt buckle device comprises a tongue piece 310 and a hook member 320. The tongue piece 310 comprises a base portion 311, a pair of longitudinal bars 313 extending from the base portion 311 in a mutually parallel relationship and a lateral bar 314 extending between the free ends of the longitudinal bars 313. Thereby, a rectangular opening 312 is defined by the base portion 311, longitudinal bars 313 and lateral bar 314.

The hook member 320 comprises a main body 323 and a hook portion 324 extending from the free end of the hook member 320 toward the base end thereof so as to define a hook opening 326 that is directed toward the base end in cooperation with the main body 323 of the hook member 320.

In this embodiment, the hook portion 324 is narrower at the entrance 325 of the hook opening 326 than in the interior thereof. The hook opening 326 is given with a substantially greater width Y1 than the lengthwise width X of the lateral bar 314 at the entrance 325. The lateral bar 314 is given with a substantially greater thickness-wise dimension Z than a lengthwise width X.

In particular, the width Y1 at the entrance 325 of the hook opening 326 is smaller than the thickness-wise width Z of the lateral bar 314, but is greater than the lengthwise width X of the lateral bar 314. Also, the width Y2 of the interior of the hook opening 326 of the hook portion 324 is substantially equal to or slightly greater than the thickness-wise width Z of the lateral bar 314. However, if the hook portion 324 is adequately flexible, the width Y2 of the interior of the hook opening 326 may be slightly smaller than the thickness-wise width Z of the lateral bar 314 so that the lateral bar 314 may be resiliently held by the hook portion 324 against the opposing surfaces of the longitudinal bars 326.

Therefore, by placing the tongue piece 310 in an upright posture as illustrated in FIG. 6*a*, the lateral bar 314 can be freely introduced into the hook opening 326. Once the lateral bar 314 is fully introduced into the hook opening 326, the tongue piece 310 may then be brought to the flat or parallel posture with the result that the lateral bar 314 is held inside the hook opening 326 as illustrated in FIG. 6*b*. Because the thickness-wise width Z of the lateral bar 314 is greater than the width Y1 at the entrance 325 of the hook opening 326, the lateral bar 314 is prevented from dislodging from the hook opening 326. If the thickness-wise width Z of the lateral bar 314 is greater than the width Y2 of the interior of the hook opening 326 of the hook portion 324, the hook portion 324 is elastically deflected, and applies a spring force onto the lateral bar 314 so that the lateral bar 314 is resiliently 15 held in the hook opening 326. Thus, the lateral bar 314 is securely held in the hook opening 326 as long as the tongue piece 310 is held in the flat position.

When the belt buckle device is desired to be released, the tongue piece 310 is tilted with the base end thereof raised with respect to the main body 323 of the hook member 320, and this allows the lateral bar 314 to be freely removed from the hook opening 326.

If desired, the thickness-wise dimension Z of the lateral bar 314 may be slightly greater than the width Y2 of the interior of the hook opening 326 of the hook portion 324 so that when the lateral bar 314 is received in the hook opening 326 of the hook portion 324, the lateral bar 314 may be resiliently held in the hook opening 326 between the hook portion 324 and main body 323 of the hook member 320 under a resilient clamping force. Although the present invention has been described in terms of preferred embodiments thereof, it is obvious to a person skilled in the art that various alterations and modifications are possible without departing from the scope of the present invention which is set forth in the appended claims.

The contents of the original Japanese patent application on which the Paris Convention priority claim is made for the present application as well as those of the prior art references mentioned in this application are incorporated in this application by reference.

The invention claimed is:

1. A belt buckle device including a tongue piece connected to an end of a belt extending in a longitudinal direction and defining a major surface and a hook member configured to be selectively connected to the tongue piece, wherein the tongue piece comprises a base end connected to the end of the belt and a free end provided with at least a first lateral bar;

wherein the hook member comprises a main body and a hook portion projecting outwardly at an angle from a surface of the main body at a free end of the main body toward a base end of the main body so as to define a hook opening between the hook portion and the main body, the hook opening directed toward the base end of the main body and configured to receive the first lateral bar therein at the free end of the tongue piece;

wherein the free end of the tongue piece is provided with an end surface substantially perpendicular to the longitudinal direction, and an adjoining inner surface substantially in parallel with a major surface of the belt, the free end of the tongue piece being configured to abut the hook member when the first lateral bar is received in the hook opening; and wherein a longitudinal dimension between the free end of the tongue piece and a base end side of the first lateral bar is substantially equal to or smaller than a width of an entrance of the hook opening, and an effective thickness of the tongue piece at the first lateral bar is greater than the width of the entrance of the hook opening.

2. The belt buckle device according to claim 1, wherein the effective thickness of the tongue piece at the first lateral bar is measured between an outer surface of the first lateral bar and an inner surface of a longitudinal bar connecting the first lateral bar with the base end of the tongue piece, the inner surface of the longitudinal bar facing away from the outer surface of the first lateral bar.

3. The belt buckle device according to claim 1, wherein the tongue piece is provided with a second lateral bar located between the first lateral bar and base end of the tongue piece, and the second lateral bar is configured to engage a surface of the hook portion facing away from the hook opening when the first lateral bar is engaged in the hook opening.

4. The belt buckle device according to claim 1, wherein the free end of the tongue piece is provided with a first magnetic member, and a part of the hook member main body adjacent to the entrance to the hook opening is provided with a second magnetic member which is magnetically attracted to the first magnetic member.

5. The belt buckle device according to claim 1, wherein a width of an interior part of the hook opening is slightly smaller than the effective thickness of the tongue piece at the first lateral bar.

6. The belt buckle device according to claim 1, wherein the tongue piece comprises a pair of spaced apart longitudinal bars that join two ends of the first lateral bar to the base end of the tongue piece.

7. The belt buckle device according to claim 1, wherein the hook opening is wider in an interior thereof than in the entrance thereof.

8. The belt buckle device according to claim 7, wherein a surface of the hook portion facing the hook opening is provided with a recess that defines the wider interior of the hook opening.

9. A femoral support assembly for transmitting a walking assistance force to a femoral part of a user, comprising a swing arm having a base end connected to an output end of a power generator and a free end configured to oppose a front part of the femoral part of the user, a femoral support member pivotally connected to the free end of the swing arm and having a support surface configured to engage the front part of the femoral part of the user, and a femoral belt configured to be passed around the femoral part of the user and having two ends attached to corresponding lateral ends of the femoral support member, one of the two ends of the femoral belt being connected to the corresponding lateral end of the femoral support member via a belt buckle device that includes a tongue piece connected to an end of a belt extending in a longitudinal direction and defining a major surface and a hook member configured to be selectively connected to the tongue piece, wherein the tongue piece comprises a base end connected to the end of the belt and a free end provided with at least a first lateral bar;

wherein the hook member comprises a main body and a hook portion projecting outwardly at an angle from a surface of the main body at a free end of the main body toward a base end of the main body so as to define a hook opening between the hook portion and the main body, the hook opening directed toward the base end of the main body and configured to receive the first lateral bar therein at the free end of the tongue piece;

wherein the free end of the tongue piece is provided with an end surface substantially perpendicular to the longitudinal direction, and an adjoining inner surface substantially in parallel with the major surface of the belt, the free end of the tongue piece being configured to abut the hook member when the first lateral bar is received in the hook opening; and wherein a longitudinal dimension between the free end of the tongue piece and a base end side of the first lateral bar is substantially equal to or smaller than a width of an entrance of the hook opening, and an effective thickness of the tongue piece at the first lateral bar is greater than the width of the entrance of the hook opening.

* * * * *